United States Patent [19]

Flavell et al.

[11] Patent Number: 4,708,334

[45] Date of Patent: Nov. 24, 1987

[54] LAYING-UP WORKPIECES OF FLEXIBLE SHEET MATERIAL

[75] Inventors: John Flavell; Michael A. Nash, both of Coventry; Anthony B. Tubb, Nuneaton, all of United Kingdom

[73] Assignee: Courtaulds Clothing Limited, London, England

[21] Appl. No.: 915,033

[22] PCT Filed: Jan. 13, 1986

[86] PCT No.: PCT/GB86/00020

§ 371 Date: Sep. 3, 1986

§ 102(e) Date: Sep. 3, 1986

[87] PCT Pub. No.: WO86/03949

PCT Pub. Date: Jul. 17, 1986

[30] Foreign Application Priority Data

Jan. 14, 1985 [GB] United Kingdom ..... 8500837

[51] Int. Cl.[4] ..... B65H 29/34

[52] U.S. Cl. ..... 271/182; 271/84; 271/900; 271/189

[58] Field of Search ..... 271/307, 308, 312, 180, 271/182, 189, 190, 191, 84, 207, 220, 900

[56] References Cited

U.S. PATENT DOCUMENTS

| | | | |
|---|---|---|---|
| 3,768,807 | 10/1973 | Spengler | 271/190 |
| 3,978,785 | 9/1976 | Stapp | 100/215 |
| 4,157,823 | 6/1979 | Morton | 271/10 |
| 4,159,108 | 6/1979 | Haft | 271/190 |
| 4,406,449 | 9/1983 | Buck | 271/189 |

FOREIGN PATENT DOCUMENTS

| | | |
|---|---|---|
| 2104132 | 4/1972 | France . |
| WO86/05467 | 9/1986 | PCT Int'l Appl. . |
| WO86/05466 | 9/1986 | PCT Int'l Appl. . |
| 1511210 | 5/1978 | United Kingdom . |
| 1570754 | 7/1980 | United Kingdom . |
| 2098183 | 11/1982 | United Kingdom . |

*Primary Examiner*—Richard A. Schacher

*Attorney, Agent, or Firm*—Davis Hoxie Faithfull & Hapgood

[57] ABSTRACT

A workpiece is placed on a retractable tray above a desired location and covered with a flexible sheet. As the tray is retracted, the flexible sheet prevents the workpiece from following the tray and allows the workpiece to move down into the desired location.

8 Claims, 7 Drawing Figures

LAYING-UP WORKPIECES OF FLEXIBLE SHEET MATERIAL

TECHNICAL FIELD

The present invention relates to laying-up workpieces in the form of pieces of flexible sheet material, that is depositing such a workpiece in a desired location and if desired, laying a second workpiece on top of the first.

Devices for carrying out such an operation have been described, for example in U.K. Patent Specifications Nos. 1,511,210 and 1,570,754. Each of those devices includes a tray on which a workpiece is placed and which is movable to a desired location where the workpiece is to be deposited. Clamps then descend on discrete portions of an edge region of the workpiece and maintain its position whilst the tray is removed.

The present invention provides a device for depositing in a desired location a workpiece constituted by a piece of flexible sheet material, which gives positive control of the workpiece and reduces the chances of the workpiece becoming rucked during its deposition.

SUMMARY OF THE INVENTION

According to the invention, a device for depositing in a desired location a workpiece, comprising a piece of flexible sheet material, the device comprising a tray for supporting the workpiece in a flat condition in a position above a desired location, means for retracting the tray, and restraining means for preventing retraction of the workpiece with the tray, whereby the workpiece can move downwards into the desired location as the tray is retracted, is characterised in that said restraining means comprises a flexible sheet, and means for depositing the flexible sheet over a workpiece on the tray and for retaining it in contact with the workpiece as, during retraction of the tray, the workpiece moves off the tray downwards into the desired location.

Suitably the means for depositing the flexible sheet over a workpiece on the tray is such that the flexible sheet is progressively lowered onto the workpiece on the tray.

In its method aspect, the invention relates to a method of depositing, in a desired location, a workpiece comprising a piece of flexible sheet material, in which a workpiece is supported on a tray, and the tray is retracted whilst retraction of the workpiece is prevented, characterised in that a flexible sheet is deposited over the workpiece resting on the tray in a position above the desired location, and the tray is retracted from under the sheet while the workpiece moves down into the desired location whilst being restrained from following the tray by the said flexible sheet.

Suitably, the flexible sheet is progressively lowered over the workpiece on the tray.

BRIEF DESCRIPTION OF THE DRAWINGS

The invention will be further described, by way of example with reference to the accompanying drawings, in which.

DESCRIPTION OF PREFERRED EMBODIMENT

Figure 1:
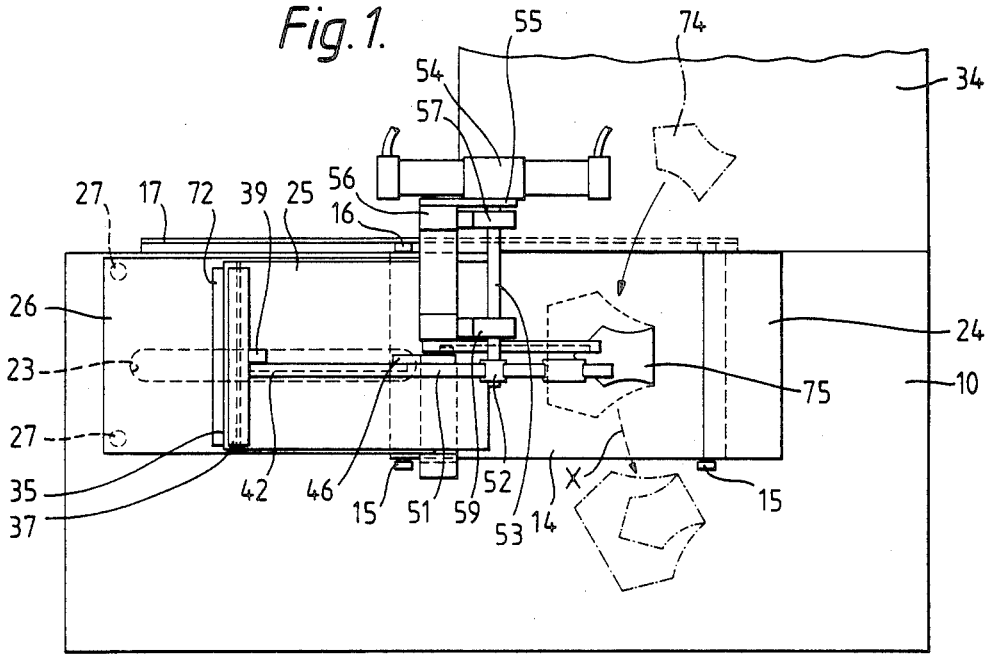
FIG. 1 is a plan of a device according to the invention.

The device shown in the drawings is able to deposit a workpiece, constituted by a piece of flexible sheet material, in a desired location.

The device comprises a table top 10 supported on stanchions 11 and 12. The stanchions 12 are connected by two horizontal beams 13. Mounted on the table top 10 is a movable tray 14. The tray 14 is supported by wheels 15 and 16. The wheels 15 run on the table top 10 and the wheels 16, with axles lower than the axles of the wheels 15, run in a guide rail 17 so that the tray 14 is guided for reciprocal movement between an extended location for deposition, of a workpiece, shown in FIGS. 1, 2 and 4, and a retracted location for the tray, shown in FIGS. 5 and 6.

Movement of the tray 14 is effected by an air-operated piston-and-cylinder device 18 mounted on brackets 19 beneath the table top 10. The piston rod 21 of the device 18 is connected to the tray 14 by a strap 22 which extends through a slot 23 in the table top 10.

Figure 2:
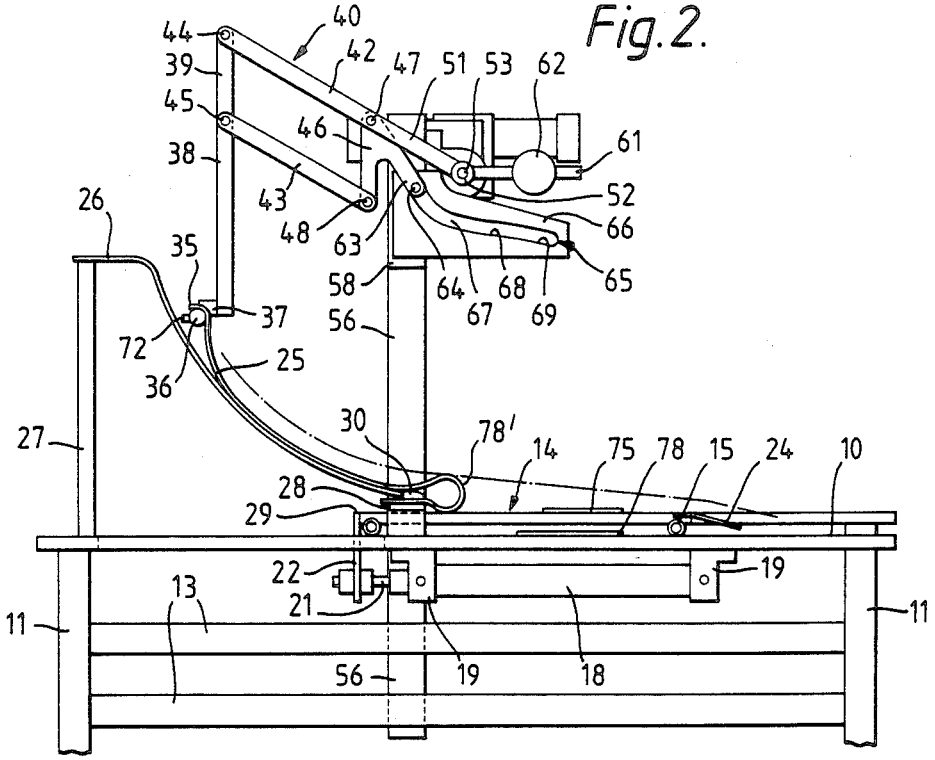
FIG. 2 is a side elevation of the device of FIG. 1 showing an early stage in the cycle of operation of the device.
Figure 4:
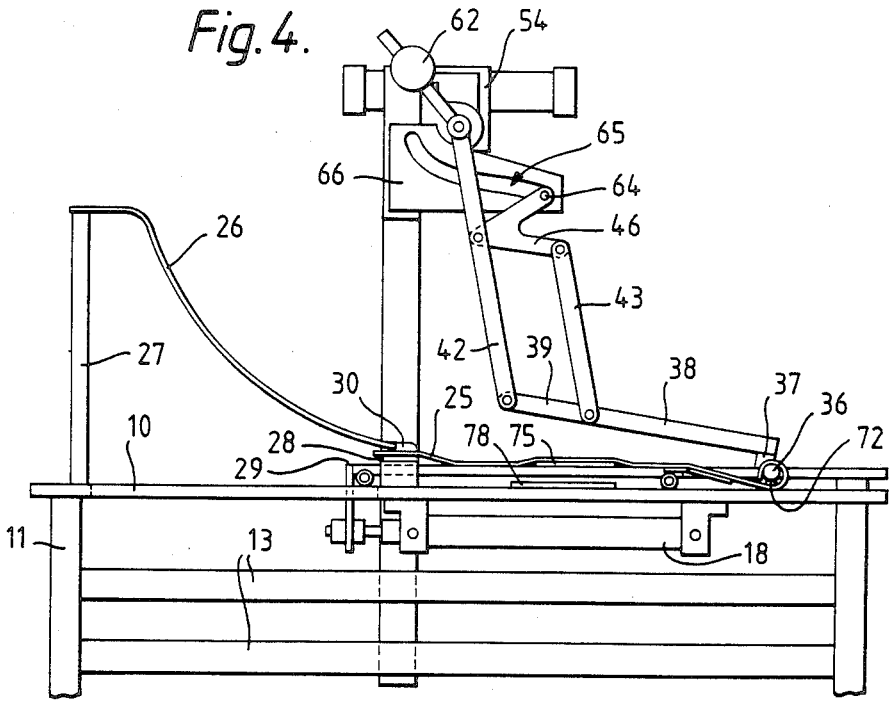
Figure 5:
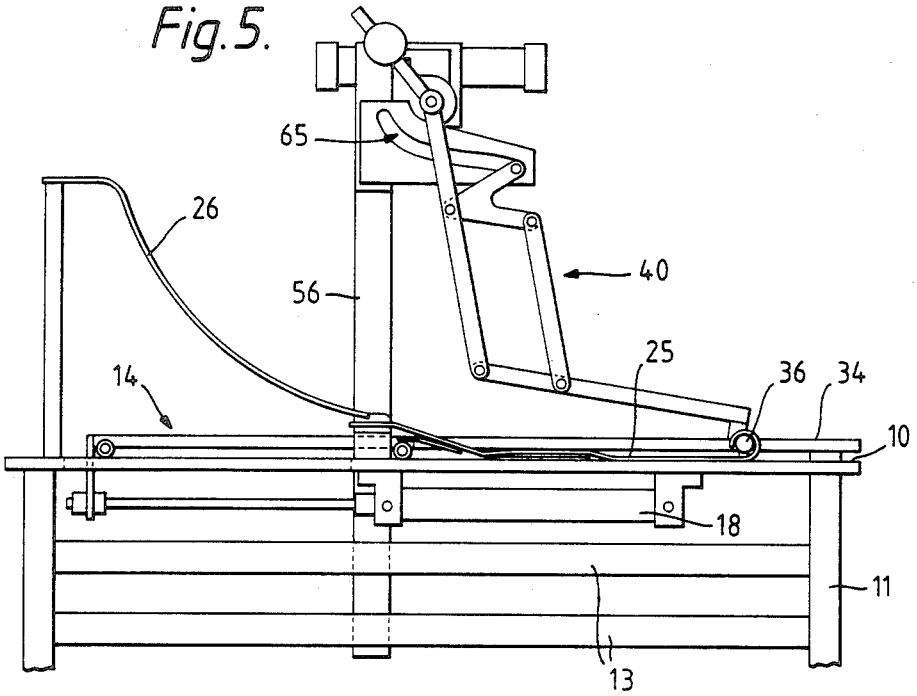
Figure 6:
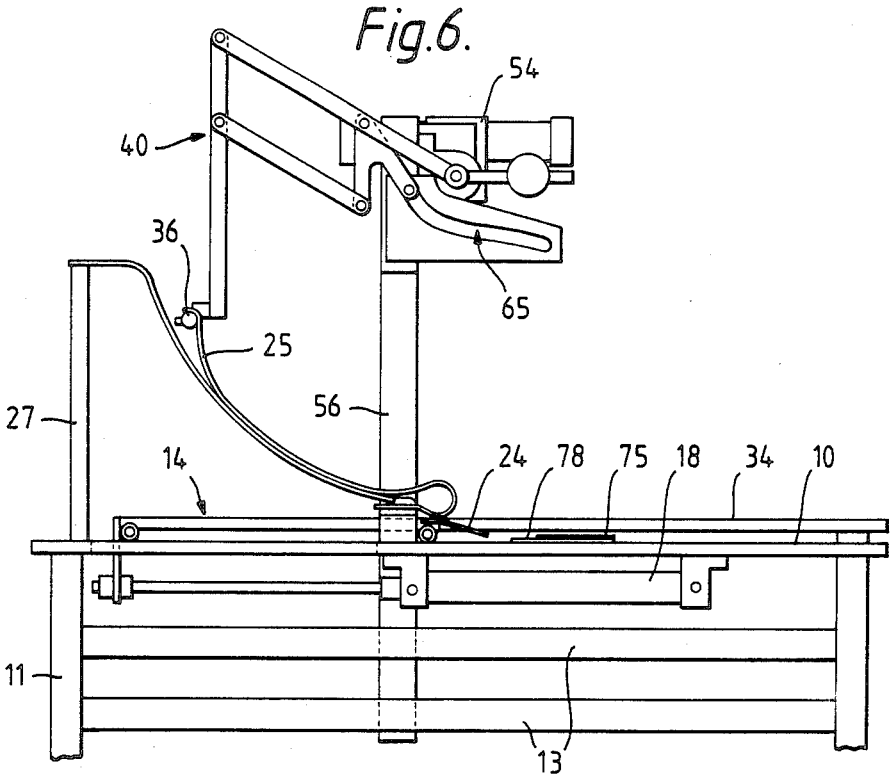

At the leading edge of the tray 14 in its movement from the retracted location of FIGS. 5 and 6 to the extended location of FIGS. 1, 2 and 4, an apron 24 is secured to the tray. The apron 24 is inclined down towards the table top 10 but terminates at a height spaced from the table top so as to remain clear of workpieces deposited on the table top 10 when the tray passes over them during retraction from the position shown in FIGS. 1, 2 and 4.

In order to retain a workpiece above the desired location during a retraction of the tray 14, a flexible sheet comprising a blanket 25 of synthetic rubber is used. In its rest position, the blanket 25 is supported on the concave upper surface of a curved metal plate 26 mounted on two pillars 27 upstanding from the table top 10. The lower end of the plate 26 is secured to an upper strip 30 secured by bolts (not shown) to a bar 28 extending close to and parallel to the table top 10 and also parallel to an edge 29 of the tray 14 and at right angles to the direction of to-and-fro movement of the tray 14. An edge of the blanket 25 is clamped between the strip 30 and the bar 28 which is secured on a pillar 32 upstanding from the table top 10 and a support 33 secured to a pillar 56 fixed to the beams 13.

A movable edge 35 of the blanket 25 is clamped between a rod 36 and a shaped bar 37 by means of bolts (not shown) extending through the rod, blanket and bar, and securing them together. The bar 37 is carried on an extension 38 of an arm 39 of a pantograph 40 having further arms 42 and 43 which are parallel to one another and are pivoted at 44 and 45 on the arm 39. The fourth arm 46 of the pantograph mechanism is pivotally connected to the arms 42 and 43 at 47 and 48 and is parallel to the arm 39.

An extension 51 of the arm 42 is secured to a collar 52 fixed on an axle 53 of a pneumatic rotary torque actuator 54. The torque actuator 54 is mounted on a plate 55 carried by the pillar 56 fixed to the beams 13. The pillar 56 carries near its upper end a bracket 57 and an arm 58 of the pillar carries a similar bracket 59. The axle 53 is mounted in bearings carried by the brackets 57 and 59.

Also secured to the collar 52 is an arm 61 carrying a counter-balance weight 62.

A sideways extension 63 from the arm 46 forming an inverted V-shape together with that arm (FIG. 2) has a cam follower 64 at its end and the cam follower 64 is engaged in a cam track 65 formed in a plate 66 secured to the arm 58 of the pillar 56. The cam follower is shown at the upper end of the cam track 65 in FIG. 2 and moving down the cam track from the position shown in FIG. 2, the locus of the cam follower 65 is first a shallow curve 67 concave about the axle 53. There follows a straight line portion 68 inclined downwardly at an angle less than 10° to the horizontal, and finally a short straight section 69 inclined downwardly at approximately 10° to the horizontal.

The torque actuator 54 can be operated to rotate the axle 53 either in a clockwise or an anti-clockwise direction. Starting from the position shown in FIG. 2, anti-clockwise rotation of the axle 53 will rotate the pantograph arm 42 anti-clockwise pushing the arm 39 in front of it. The cam follower 64, following the cam track, will maintain the bar 37 at an approximately constant distance from the plate 26 during the initial part of the movement of the blanket 25 during which the cam follower 64 will traverse the first shallow curve 67 of the cam track 65 and the bar 37 with the edge 35 of the blanket 25 will move near to the upper strip 30.

As the bar 37 moves over the tray 14, the cam follower 64 will traverse the first straight section 68, moving the bar 37 over the tray 14. Finally, the bar 37 will move down over the apron 24 whilst the cam follower 64 moves along the final straight section 69 of the cam track 65 and at this stage, the blanket 25 will have been rolled out over the tray 14 to the position shown in FIG. 4. A strip of sponge rubber 72 secured along the rod 36 serves here to press the adjacent region of the blanket 25 against the table top 10.

On operating the torque actuator 54 to rotate the axle 53 clockwise from the position shown in FIG. 4, the pantograph 40 will be caused to retract its path so that the bar 37 will carry the edge 35 of the blanket 25 back above the tray 14 and upwardly over the plate 26 to the position shown in FIG. 2. The edge 35 of the blanket 25 will be maintained always above the tray 14 or apron 24 at approximately a constant distance from the plate 26.

The operation of the device shown in the drawings will now be described with reference to FIGS. 2, 4, 5 and 6. FIG. 2 shows the device in the starting position of a cycle of operations (except that in FIG. 2, one workpiece 78 is shown in the deposited position and one 75 is shown on the tray 14).

Figure 3:
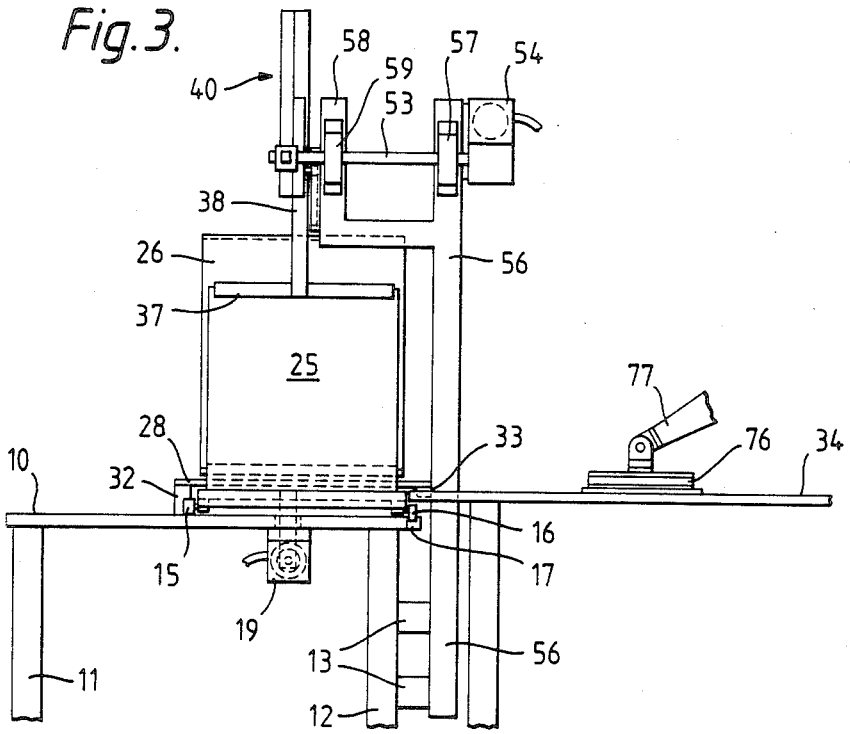
FIG. 3 is an end elevation of the device of FIG. 1, FIGS. 4, 5 and 6 are further side elevations of the device of FIG. 1 showing different stages in operation of the device

The first procedure in an operating cycle, with the tray 14 in the position shown in FIG. 2, is to place a workpiece 75 in a flat opened-out condition in a predetermined position on a table top 34. A manipulator head 76 (FIG. 3) carried by an arm 77 of a programmable manipulator (not shown) is then brought down on top of the workpiece 75 and moves it onto the tray 14, which is at the same height as the table top 34. This movement carries the workpiece 75 to the desired location above the table top 10.

The blanket 25 is next lowered onto the workpiece 75 to serve as retaining means to retain the workpiece above the desired location during retraction of the tray 14. Lowering of the blanket 25 is effected by operating the torque actuator 54 to rotate the axle 53 anti-clockwise in FIG. 2. As the bar 37 descends, carrying with it the edge 35 of the blanket 25, the blanket is progressively pushed out over the tray 14 with an unrolling action of a folded region 78 of the blanket. Thus, a region of the blanket 25 makes initial contact with the workpiece 75 and part of the blanket is then progressively lowered onto the workpiece so that contact between the workpiece and the blanket is progressively established starting at one region of the blanket and moving progressively across the blanket. The end of this part of the operating cycle is shown in FIG. 4.

Next, the tray 14 is retracted to the left in FIG. 4 by operation of the piston-and-cylinder device 18 and the result of this movement of the tray 14 is shown in FIG. 5. The workpiece 75 is retained in its desired position by the blanket 25 and is thus deposited in a desired location on the table top 10 on top of, and with one of its edges aligned with an edge of, a previous workpiece 78 deposited on the table top in a predetermined position in an earlier cycle of operation of the device.

Next, the blanket 25 is retracted by operating the torque actuator 54 to turn the axle 53 in a clockwise direction and this leaves the two workpieces 75 and 78 superposed on the table top 10 in the desired position (FIG. 6). The workpieces can now be moved together to the next stage of a garment assembly process by the manipulator head 76, as indicated by the arrow X in FIG. 1.

The table top 34, which has to be at the level of the tray 14 to allow a workpiece 75 to be slid from the table top to the tray, may be mounted so that it can be raised and lowered so that with the table top 34 lowered, a workpiece can be slid across another table top (not shown) at the level of the table top 10 onto the table top 34, the table top 34 can then be raised to allow transfer (by sliding) of the workpiece to the tray 14 as part of the operating cycle described above. Such an arrangement avoids any need for a change in the table levels such as that shown in the drawings, which may be inconvenient if in a garment assembly line, a number of workpiece depositing devices are required.

Figure 7:
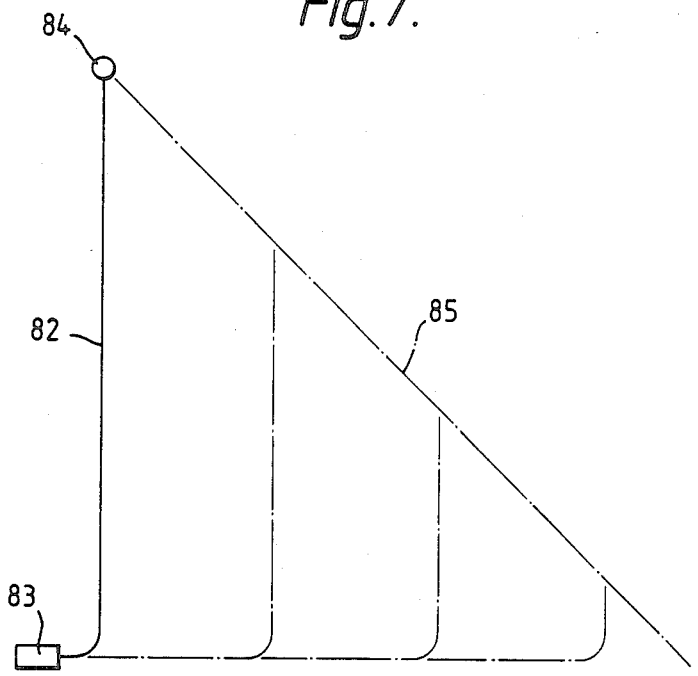
FIG. 7 is a diagram illustrating the mode of operation of a further device according to the invention.

FIG. 7 shows an alternative configuration for a flexible sheet in the form of a blanket 82 a lower edge of which is secured to a fixed bar 83 and the upper edge of which is secured to a movable bar 84. A pantograph mechanism, similar to that shown in FIGS. 1 to 6, can be used to support and move the bar 84, but other mechanisms can also be used for this purpose. For example, the bar 84 may be supported by an arm or arms of a programmable manipulator.

The locus 85 of the bar 84 in laying down the blanket 82 on a workpiece is indicated by a chain-dotted line in FIG. 7, as are successive positions of the blanket 82. Contact between the blanket 82 and a workpiece beneath it is progressively established in a similar manner to that described above in relation to the blanket 25.

A blanket of relatively heavy weight construction is preferred and a solid commercial grade neoprene sheeting with a so-called "cloth finish" of a thickness of 3.2 mm (⅛"), a density of 1.6 gm/cm$^2$ and a shore (or IRHD) hardness of 60°/70° has proved to be very satisfactory. A blanket of rubber elastic material with a density in the range 1.2 to 2.0 gm/cm$^2$ would be preferred.

We claim:

1. A device for depositing in a desired location a workpiece (75, 78) comprising a piece of flexible sheet material, the device comprising a tray (14) for supporting the workpiece (75, 78) in a flat condition in a position above a desired location, means (18) for retracting the tray (14), and restraining means for preventing retraction of the workpiece with the tray, whereby the workpiece (75, 78) can move downwards into the desired location as the tray (14) is retracted, characterised in that said restraining means comprises a flexible sheet (25), and means (40) for depositing the flexible sheet (25) over a workpiece (75, 78) on the tray (14) and for retaining it in contact with the workpiece (75, 78) as, during retraction of the tray (14), the workpiece (75, 78) moves off the tray (14) downwards into the desired location.

2. A device according to claim 1, characterised in that the means (40) for depositing the flexible sheet (25) over a workpiece (75, 78) on the tray (14) is such that the flexible sheet (25) is progressively lowered onto the workpiece (75, 78) on the tray (14).

3. A device according to claim 1, characterised in that the means for depositing the flexible sheet (25) over a workpiece (75, 78) on the tray (14) is such that a region of the flexible sheet (25) is brought into initial contact with the workpiece (75, 78) on the tray (14) and a further part of the flexible sheet (25) is progressively lowered onto the workpiece (75, 78) so that contact between the workpiece (75, 78) and the flexible sheet (25) is progressively established starting at the said region of the flexible sheet (25) and moving progressively across the said further part of the flexible sheet (25).

4. A device according to claim 3, characterised in that said flexible sheet (25) is initially supported on the concave upper surface of a curved plate (26) extending upwardly and away from the tray (14), said flexible sheet (25) is clamped near the lower end of said curved plate (26) adjacent to the tray (14) so that the flexible sheet (25) curls over onto said curved plate (26) and its movable edge (35) is carried by the means (40) for depositing the flexible sheet (25) over the workpiece (75, 78) on the tray (14), so that the flexible sheet is lowered by said means (40) moving along a path above said curved plate (26) down towards the tray (14) and progressively pushing said flexible sheet (25) out over the tray (14) with an unrolling action.

5. A device according to claim 1, characterised in that the flexible sheet (25) is a blanket of rubber elastic material having a density in the range 1.2 to 2.0 $gm/cm^2$.

6. A method of depositing in a desired location a workpiece (75, 78) comprising a piece of flexible sheet material, in which a workpiece (75, 78) is supported on a tray (14), and the tray (14) is retracted whilst retraction of the workpiece (75, 78) is prevented, characterised in that a flexible sheet (25) is deposited over the workpiece (75, 78) resting on the tray (14) in a position above the desired location, and the tray (14) is retracted from under the sheet while the workpiece (75, 78) moves down into the desired location whilst being restrained from following the tray (14) by the said flexible sheet (25).

7. A method according to claim 6, characterised in that the flexible sheet (25) is progressively lowered over the workpiece (75, 78) on the tray (14).

8. A method according to claim 6, characterised in that a region of the flexible sheet (25) is brought into initial contact with the workpiece (75, 78) and a further part of the flexible sheet (25) is progressively lowered on to the workpiece (14) so that contact between the workpiece (75, 78) and the flexible sheet (25) is progressively established starting at the said region of the flexible sheet (25) and moving progressively across said further part of the flexible sheet (25).

* * * * *